US011680720B2

(12) United States Patent
Subban et al.

(10) Patent No.: US 11,680,720 B2
(45) **Date of Patent: *Jun. 20, 2023**

(54) PERSONAL COMFORT VARIABLE AIR VOLUME DIFFUSER

(71) Applicant: Trane International Inc., Davidson, NC (US)

(72) Inventors: Rajasudhakar Subban, Tamilnadu (IN); Rajat Subhra Raj, Kamataka (IN)

(73) Assignee: Trane International Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/652,876

(22) Filed: Feb. 28, 2022

(65) Prior Publication Data

US 2022/0252289 A1 Aug. 11, 2022

Related U.S. Application Data

(63) Continuation of application No. 16/888,317, filed on May 29, 2020, now Pat. No. 11,293,654, which is a (Continued)

(51) Int. Cl.

| | |
|---|---|
| ***F24F 11/00*** | (2018.01) |
| ***F24F 13/08*** | (2006.01) |
| ***F24F 13/10*** | (2006.01) |
| ***F24F 3/044*** | (2006.01) |
| ***F24F 13/16*** | (2006.01) |

(Continued)

(52) U.S. Cl.

CPC ..... *F24F 11/0001* (2013.01); *F24F 3/0442* (2013.01); *F24F 13/08* (2013.01); *F24F 13/10* (2013.01); *F24F 13/16* (2013.01); *F24F 11/56* (2018.01); *F24F 2110/30* (2018.01); *F24F 2120/20* (2018.01); *F24F 2140/10* (2018.01);

(Continued)

(58) Field of Classification Search

CPC ..... F24F 11/72; F24F 11/77; F24F 11/0001; F24F 2110/40; F24F 123/20

USPC ..... 454/238, 256, 292–304

See application file for complete search history.

(56) References Cited

U.S. PATENT DOCUMENTS 10,670,285 B2 * 6/2020 Subban ..... F24F 13/10

* cited by examiner

*Primary Examiner* — Vivek K Shirsat

(74) *Attorney, Agent, or Firm* — Womble Bond Dickinson (US) LLP

(57) ABSTRACT

A method for providing personalized comfort to occupants of an environmentally conditioned space includes sensing a pre-adjustment pressure within a variable air volume diffuser, remotely adjusting a position an individually-adjustable directional outlet of the variable air volume diffuser, sensing a post-adjustment pressure within the variable air volume diffuser, and modifying the airflow through the variable air volume diffuser such that the post-adjustment pressure is equal to the pre-adjustment pressure. The variable air volume diffuser includes individually-adjustable directional outlets and a controller configured to regulate air pressure within the variable air volume diffuser when an individually adjustable directional outlet is adjusted. A user device in operative communication with the variable air volume diffuser includes a user interface to remotely adjust an adjustable directional outlet of the variable air volume diffuser to provide personalized comfort for the user. In embodiments, the variable air volume diffuser responds to spoken commands.

20 Claims, 8 Drawing Sheets

Related U.S. Application Data continuation of application No. 15/492,856, filed on Apr. 20, 2017, now Pat. No. 10,670,285.

(51) Int. Cl.

| | |
|---|---|
| ***F24F 11/56*** | (2018.01) |
| ***F24F 120/20*** | (2018.01) |
| ***F24F 110/30*** | (2018.01) |
| ***F24F 140/10*** | (2018.01) |

(52) U.S. Cl.

CPC ..... *F24F 2221/14* (2013.01); *F24F 2221/38* (2013.01)

PERSONAL COMFORT VARIABLE AIR VOLUME DIFFUSER

CROSS-REFERENCE TO RELATED APPLICATION

This application is a Continuation of U.S. Utility patent application Ser. No. 16/888,317 entitled "PERSONAL COMFORT VARIABLE AIR VOLUME DIFFUSER" and filed May 29, 2020; which is a Continuation of U.S. Utility patent application Ser. No. 15/492,856 entitled "PERSONAL COMFORT VARIABLE AIR VOLUME DIFFUSER" and filed Apr. 20, 2017, now U.S. Pat. No. 10,670,285, the entirety of which is hereby incorporated by reference herein for all purposes.

BACKGROUND

1. Technical Field

The present disclosure relates generally to heating, ventilation, and air conditioning (HVAC) systems, and in particular, to a variable air volume diffuser that provides personalized air delivery to individual occupants of a building space.

2. Background of Related Art

In HVAC systems, conditioned air is delivered to a building space by a variable air volume (VAV) diffuser. The VAV diffuser is often ceiling-mounted and includes a damper that regulates the flow of air passing through the diffuser, and outlet vents through which the conditioned air exits the diffuser into the space. The outlet vents typically include a grille or a series of louvers that direct the conditioned air into the space.

Known diffusers may have drawbacks in that they deliver conditioned air to the building space in a manner intended to satisfy the requirements of the space as a whole, without considering the requirements of individual occupants of the space. A VAV diffuser that addresses these shortcomings in a user-friendly and cost-effective manner would be a welcome advance in the art.

SUMMARY

In one aspect, the present disclosure is directed to a method of operating a variable air volume diffuser having a plurality of individually adjustable directional outlets. The method includes sensing a pre-adjustment pressure within the variable air volume diffuser, adjusting a position of one of the plurality of individually adjustable directional outlets, sensing a post-adjustment pressure within the variable air volume diffuser, and modifying the airflow through the variable air volume diffuser such that the post-adjustment pressure is substantially equal to the pre-adjustment pressure.

In some embodiments, the method includes sensing the rate of airflow through the variable air volume diffuser.

In some embodiments, the method includes determining whether rate of airflow through the variable air volume diffuser is less than a predetermined threshold for a predetermined period of time and returning the individually adjustable directional outlets to a default position in response to the determining.

In some embodiments, the method includes determining whether the rate of airflow through the variable air volume diffuser is less than a predetermined threshold for a predetermined period of time, and returning an airflow-modifying device included in the variable air volume diffuser to a default position in response to the determining.

In some embodiments, the method includes receiving an adjustment command from a user device, wherein the adjusting is in response to the adjustment command.

In some embodiments, the method includes transmitting a variable air volume diffuser identifier to a user device and displaying the variable air volume diffuser identifier on the user device.

In some embodiments, the method includes selecting, on the user device, selecting a variable air volume diffuser identifier from among a plurality of variable air volume diffuser identifier.

In some embodiments, modifying the airflow through the variable air volume diffuser includes changing the position of a damper included within the variable air volume diffuser.

In another aspect, the present disclosure is directed to a variable air volume diffuser that includes a plurality of individually adjustable directional outlets, and a controller configured to regulate air pressure within the variable air volume diffuser when an individually adjustable directional outlet is adjusted.

In some embodiments, the variable air volume includes an actuator in operative communication with the controller and operatively associated with at least one of the individually adjustable directional outlets. In some embodiments, the actuator comprises a stepper motor.

In some embodiments, the variable air volume diffuser includes a communications interface. In some embodiments, the communications interface is configured to receive an adjustment command from a user device. In some embodiments, the communications interface is configured to receive an adjustment command spoken by a user.

In some embodiments, the communications interface is configured to transmit a variable air volume diffuser identifier to a user device.

In some embodiments, the variable air volume diffuser includes a damper configured to regulate airflow through the variable air volume diffuser. In some embodiments, the variable air volume diffuser includes an actuator in operative communication with the controller and operatively associated with the damper.

In some embodiments, the variable air volume diffuser includes a sensor in operative communication with the controller and configured to sense an air property within the variable air volume diffuser. The sensed air property may be an air pressure, a rate of airflow, an air temperature, and/or an air humidity.

In yet another aspect, the present disclosure is directed to a personalized comfort variable air volume diffuser system having a variable air volume diffuser having a plurality of individually remotely-adjustable directional outlets, and a user interface presentable on a user device in operative communication with the variable air volume diffuser and configured to remotely adjust an adjustable directional outlet of the variable air volume diffuser.

Other features and advantages will become apparent from the following description of the preferred embodiments, taken in conjunction with the accompanying drawings.

BRIEF DESCRIPTION OF THE DRAWINGS

Various embodiments of the disclosed system and method are described herein with reference to the drawings wherein.

Figure 1:
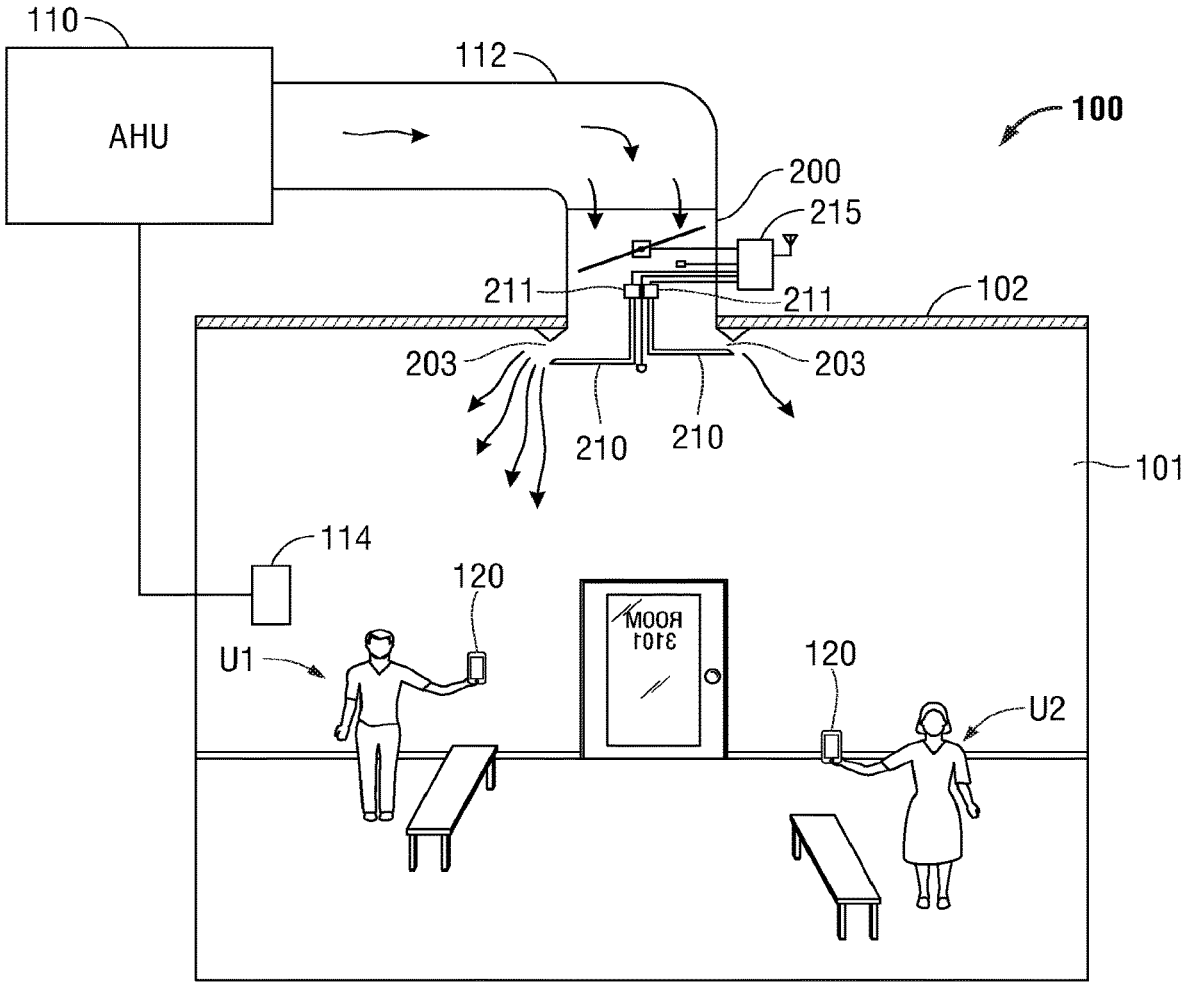
FIG. 1 illustrates a conditioned space incorporating a personalized comfort VAV system in accordance with an embodiment of the present disclosure.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings, however, the disclosed embodiments are merely examples of the disclosure, which may be embodied in various forms. Well-known functions or constructions and repetitive matter are not described in detail to avoid obscuring the present disclosure in unnecessary or redundant detail. Therefore, specific structural and functional details disclosed herein are not to be interpreted as limiting, but as a basis for the claims and examples for teaching one skilled in the art to variously employ the present disclosure in any appropriately-detailed structure. In this description, as well as in the drawings, like-referenced numbers represent elements which may perform the same, similar, or equivalent functions. The word "exemplary" is used herein to mean "serving as a non-limiting example, instance, or illustration." Any embodiment described herein as "exemplary" is not necessarily to be construed as preferred or advantageous over other embodiments. The word "example" may be used interchangeably with the term "exemplary."

Aspects of the present disclosure are described herein in terms of functional block components and various processing steps. It should be appreciated that such functional blocks configured to perform the specified functions may be embodied in mechanical devices, electromechanical devices, analog circuitry, digital circuitry, and/or modules embodied in a computer. For example, the present disclosure may employ various discrete components, integrated circuit components (e.g., memory elements, processing elements, logic elements, look-up tables, and the like) which may carry out a variety of functions, whether independently, in cooperation with one or more other components, and/or under the control of one or more processors or other control devices. One skilled in the art will also appreciate that, for security reasons, any element of the present disclosure may includes any of various suitable security features, such as firewalls, access codes, authentication, encryption, de-encryption, compression, decompression, and/or the like. It should be understood that the steps recited herein may be executed in any order and are not limited to the order presented. Moreover, two or more steps or actions recited herein may be performed concurrently.

FIG. 1 illustrates an exemplary embodiment of a personalized comfort VAV system 100 in accordance with the present disclosure. VAV system 100 is installed in conditioned space 101 which can be, for example, an office, workroom, conference room, manufacturing floor of a factory, or any space where two or more people may gather. Conditioned air is delivered to conditioned space 101 by personalized comfort VAV diffuser 200 that, typically, is mounted through ceiling 102 of conditioned space 101. VAV diffuser 200 receives conditioned air from an air handler unit 110 via an air duct 112. A temperature sensor 114 is operatively coupled to air handler unit 110 to control the delivery of conditioned air into conditioned space 101 to maintain a desired temperature setpoint therein. Temperature sensor 114 may, for example, be included in a thermostat, or may be a standalone sensor. While FIG. 1 shows a single air handler 110 feeding a single VAV diffuser 200 associated with a single space 101, it should be understood that the present disclosure contemplates any suitable configuration of air handler units 110, personalized comfort VAV diffusers 200 and conditioned spaces 101, such as, for example, an air handler unit 110 that feeds a plurality of personalized comfort VAV diffusers 200 and/or a conditioned space that includes a plurality of personalized comfort VAV diffusers 200.

VAV diffuser 200 includes a plurality of adjustable air guides 210 that are arranged to direct airflow from VAV diffuser 200 in a specific direction. While in the various example embodiments discussed here, VAV diffuser 200 is shown to have two or four adjustable air guides 210, the present disclosure is not so limited and it should be understood that VAV diffuser 200 may include any number of adjustable air guides 210. VAV diffuser 200 includes controller 215 that in one aspect is configured for wireless communication with one or more user devices 120 to provide personalized air delivery to individual users of the user devices 120, e.g., user U1 and user U2. User device 120 may include, for example, a smart phone, tablet computer, notebook computer, a dedicated handheld or fixed keypad (remote control), and so forth.

Figure 2:
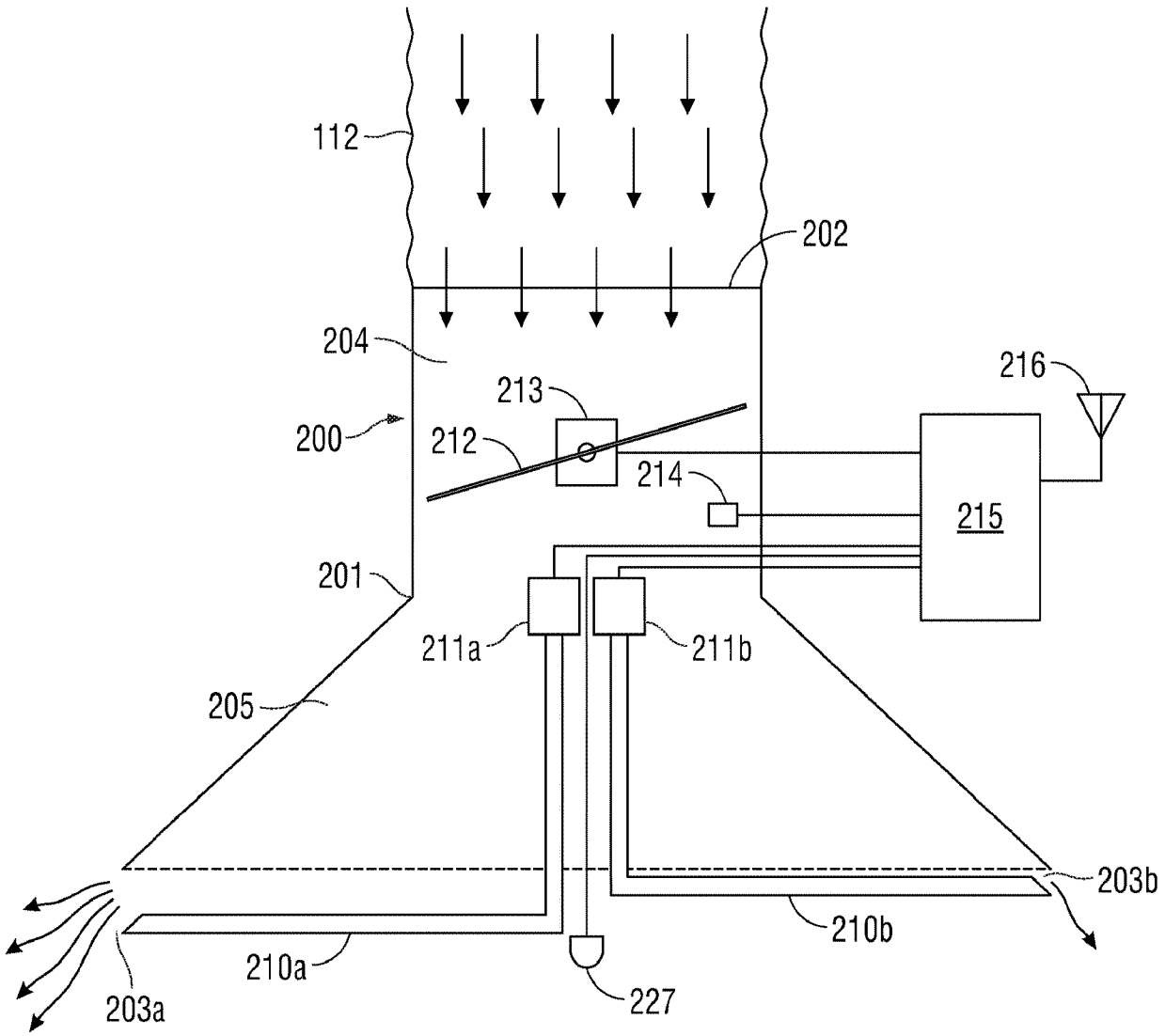
FIG. 2 is a detailed view of a personalized comfort VAV diffuser in accordance with an embodiment of the present disclosure.

In more detail, FIG. 2 illustrates an exemplary construction of VAV diffuser 200. VAV diffuser 200 includes a housing 201 having an inlet 202 through which conditioned air enters an inlet plenum 204. A motorized damper 212 actuated by stepper motor 213 controls the flow of conditioned air from inlet plenum 204 to outlet plenum 205. A sensor 214 senses a property of the conditioned air within outlet plenum 205, such as air pressure. In embodiments, sensor 214 may additionally or alternatively sense the air temperature, air velocity, air humidity, and/or noise level within outlet plenum 205. Each adjustable air guide 210 is operatively associated with a corresponding stepper motor 211 that is configured to adjust the position of adjustable air guide 210 to control the amount of conditioned air flowing from air outlet 203. In the example embodiment depicted in FIG. 2, stepper motors 211*a* and 211*b* are arranged to lower and raise adjustable air guides 210*a* and 210*b*, respectively, to increase or decrease the size of respective air outlets 203*a* and 203*b* and increase or decrease the volume of air flowing through air outlets 203*a* and 203*b*, respectively. Alternatively, damper 212 and/or any of adjustable air guides 210 may be actuated by, for example, a servo motor, pneumatic actuator, wax motor, and so forth.

Occupancy sensor 227 senses when one or more persons are present within conditioned space 101 and may include, for example, a passive infrared (PIR) motion detector, a video camera configured to sense motion or objects, an RF signal detector configured to detect the presence of RF emissions from a user mobile device, an acoustic detector configured to sense the sounds of human activity, and so on. In some embodiments having a microphone 224 as described below, the function of occupancy sensor 227 may be performed by microphone 224.

VAV diffuser 200 includes controller 215 that is in operative communication with stepper motor 213 to control the position of damper 212; with stepper motors 211*a*, 211*b* etc. to control the position of respective adjustable air guides 210*a*, 210*b* etc., with with sensor 214 to receive a property of conditioned air within outlet plenum 205, and with occupancy sensor 227 to detect when conditioned space 101 is occupied. Controller 215 is configured for operative communication with one or more user devices 120 to transmit identification information thereto and receive personal comfort settings therefrom. In the present embodiment, controller 215 communicates with the one or more user devices 120 a wireless communications link via antenna 216. In embodiments, controller 215 may additionally or alternatively communicate with the one or more user devices 120 via a wired communications link. In embodiments, controller 215 includes an optical receiver (phototransistor) to communicate with a user device via an infrared communications link. In some embodiments, controller 215 includes audio input and output capability (e.g., a microphone and speaker) to communicate directly with a user via audio prompts and voice recognition of spoken user commands.

Figure 3:
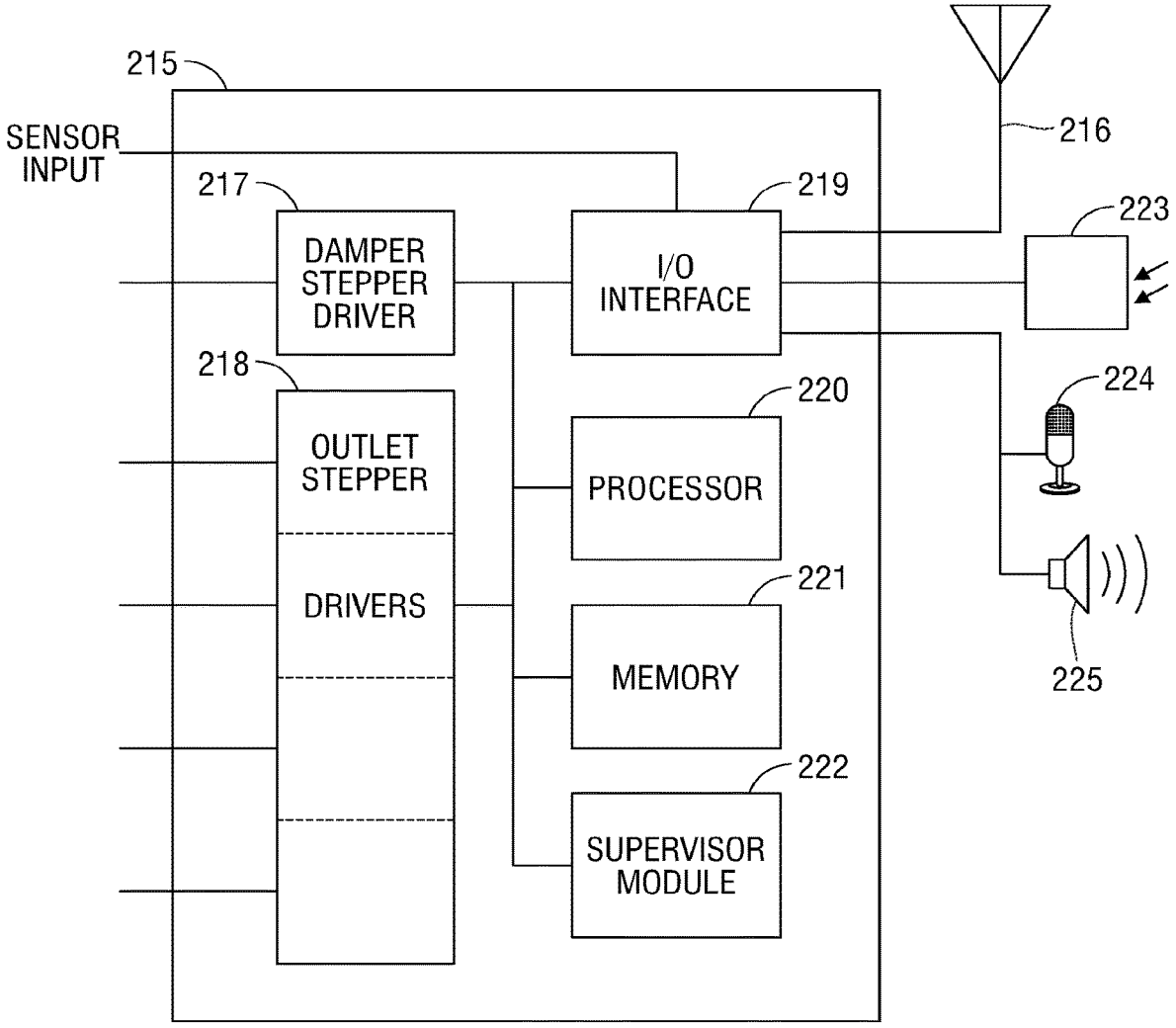
FIG. 3 is a schematic view of a personalized comfort VAV controller in accordance with an embodiment of the present disclosure.

FIG. 3 is a more detailed view of an embodiment of controller 215. Controller 215 includes a processor 220 operatively coupled with a memory 221. Memory 221 may include volatile and non-volatile memory, such as RAM, ROM, EEPROM, flash memory, optical, or magnetic disk memory, in any desired form factor, such as dual inline package (DIP), surface mount device (SMD), SD card, USB stick, hard drive, solid state drive (SSD) and so forth. An input/output (I/O) interface 219 is operatively coupled to processor 220 to support communications with sensor 214, occupancy sensor 227, and other devices as described herein. In one embodiment, I/O interface 219 includes antenna 216 and supports a wireless networking protocol based on the IEEE 802.15.4 low power wireless standard to implement a near-me area network (NAN) to enable mobile devices 120 in proximity with VAV diffuser 200 to communicate with VAV diffuser 200. Other embodiment may optionally or alternatively implement other wireless communications protocols, such as Bluetooth, IEEE 802.11 (WiFi), and so forth.

In another embodiment, IO interface 219 is operatively coupled to a photoreceptor 223, such as an infrared (IR) phototransisitor, to receive communications from an IR emitter included in a handheld remote control device or in an IR peripheral suitable for use with a mobile device 120. In yet another embodiment, I/O interface 219 is operatively coupled to a microphone 224 and speaker 225 to enable VAV diffuser 200 to respond to spoken commands and issue voice prompts to enable direct communications with a user without the need for the user to be in possession of a mobile device.

Controller 215 includes stepper driver 217 that includes circuitry for driving damper stepper motor 213, and stepper driver 218 that includes circuitry for driving the one or more air guide stepper motors 211. In embodiments where alternative actuators are employed, e.g., servo motor, pneumatic actuator, wax motor, etc., the appropriate driving circuitry is utilized.

Controller 215 includes supervisor module 222 that is configured to receive personal comfort settings, e.g., an adjustable air guide 210 setting, from a user; to adjust the position of adjustable air guide 210 in accordance with the received user-specified setting; to receive from sensor 214 a property of the conditioned air within outlet plenum 205 (e.g., the air pressure); and to adjust the position of damper 212 in response to the sensed property. Supervisor module 222 may be embodied as any suitable software and/or hardware as will be appreciated by those having skill in the art and/or as described herein.

Figure 4A:
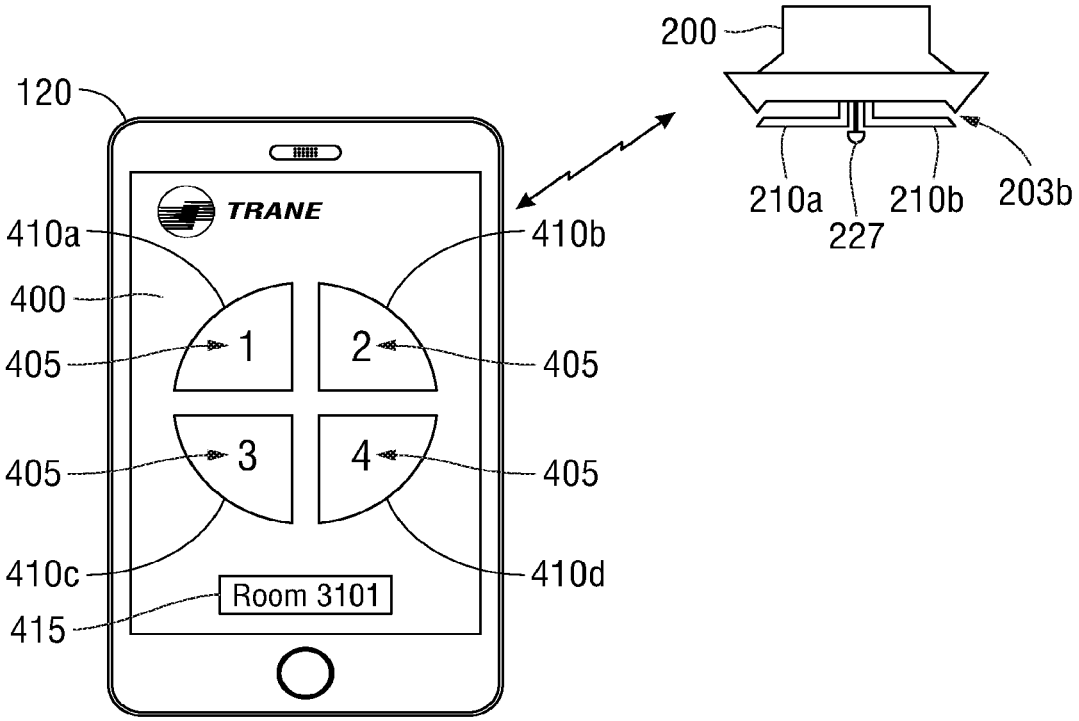
FIGS. 4A-4B illustrate an embodiment of a remote device user interface of a personalized comfort VAV system in accordance with the present disclosure.
Figure 5A:
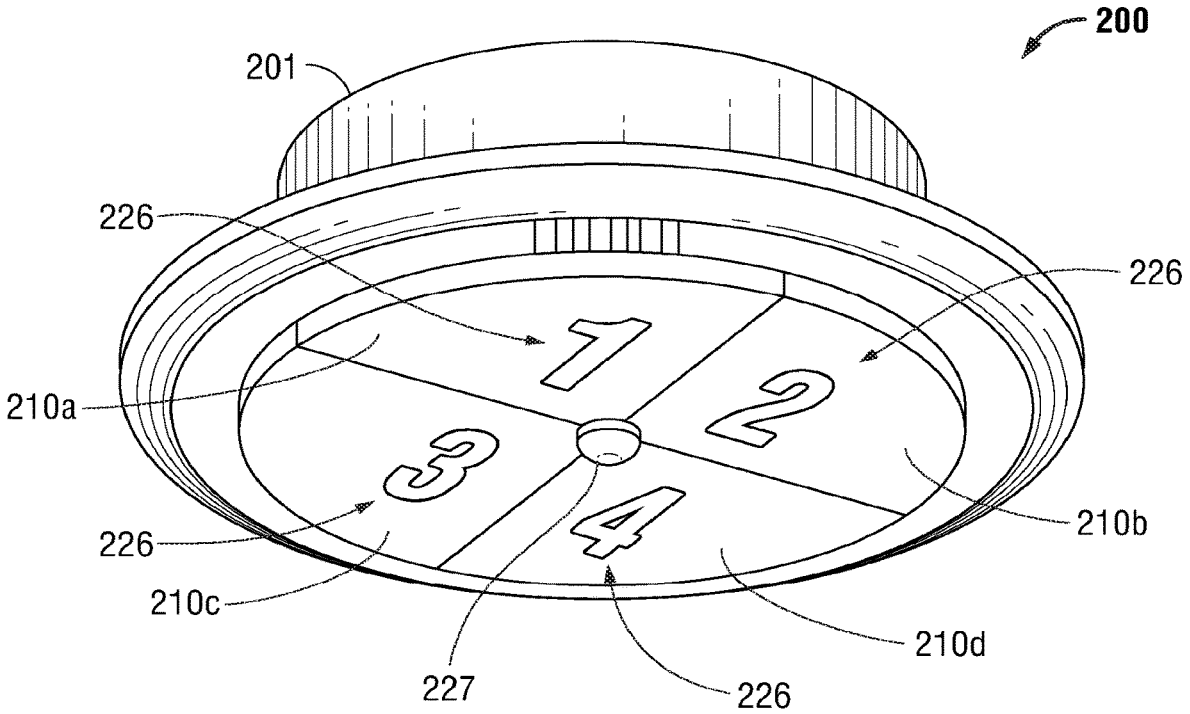
FIGS. 5A-5C are perspective views of an embodiment of a personalized comfort VAV controller in accordance with the present disclosure.

Referring to FIGS. 1, 4A, and 5A, during use each adjustable air guide 210 of VAV diffuser 200 may initially be adjusted to a middle position, e.g., at approximately 50% open (FIG. 4A). VAV diffuser 200 delivers cooled air into conditioned space 101 which, in the present example, is identified as Room 3101 and which is occupied by two persons, user U1 who is comfortable with the environmental conditions in the room, and user U2 who is feeling uncomfortably cold. Since each adjustable air guide 210 is adjusted to the same middle position, the volume of air flowing in each direction is substantially equal.

Figure 4B:
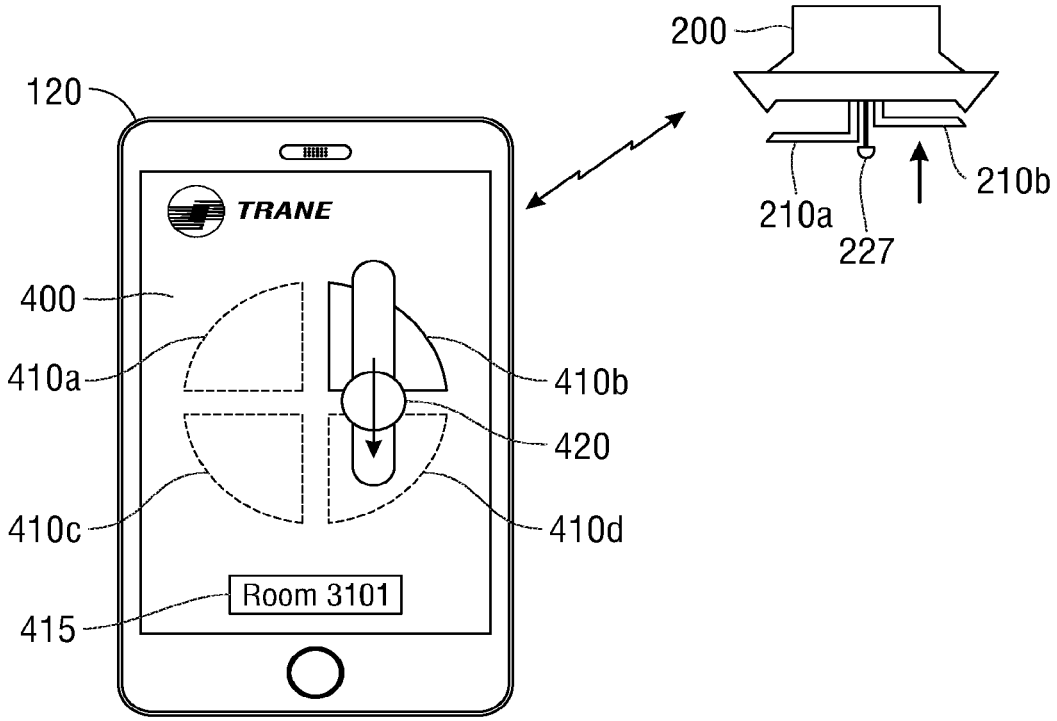

To enhance user U2's comfort, he or she utilizes the present invention to reduce the volume of air flowing in his or her direction by adjusting the appropriate adjustable air guide 210, e.g., the air guide(s) facing most towards user U2. To accomplish this, user U2 utilizes his or her user device 120 to establish an operative connection with VAV diffuser 200. As shown in FIGS. 4A and 4B, a user interface 400 is presented on user device 120 which includes a visual representation 410*a*, 410*b*, etc. of each adjustable air guide 210*a*, 210*b*, etc. of VAV diffuser 200. An application program ("app"), a web app (e.g., a javascript program executing within a browser application), or other suitable software architecture may be employed to present user interface 400 to the user.

Figure 5B:
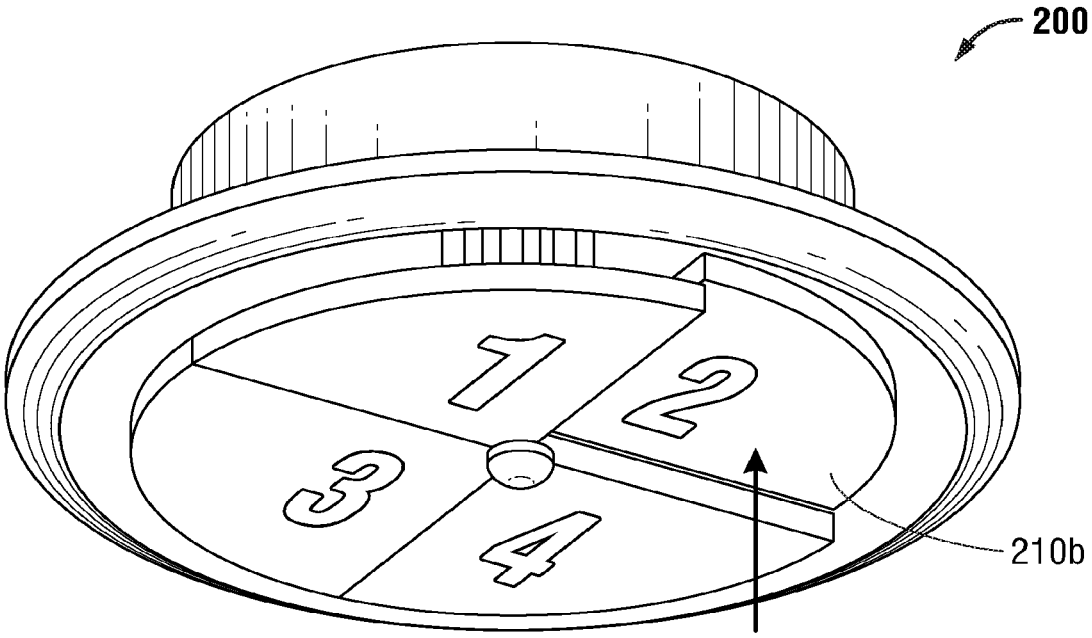
Figure 5C:
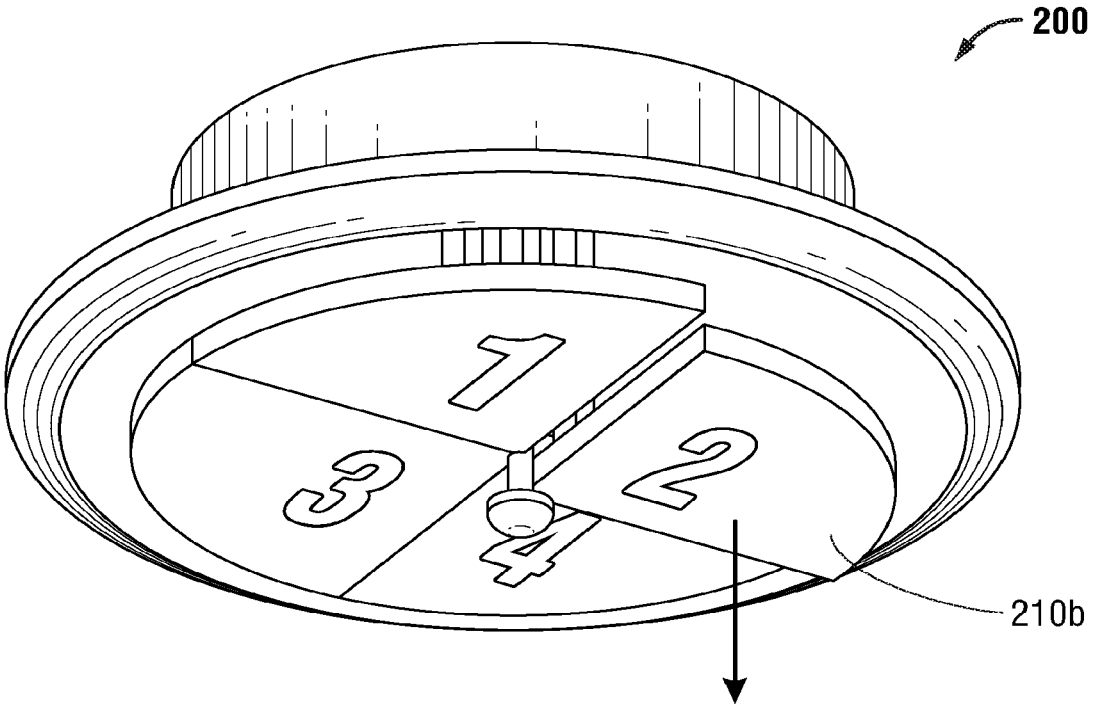

To enable the user to identify the appropriate adjustable air guide 210 for adjustment, each visual representation 410*a*, 410*b*, etc. includes an identifying indicia 405 which corresponds to a matching indicia 226 disposed on a surface of each adjustable air guide 210*a*, 210*b*, etc. As seen in FIGS. 5A-5C, indicia 226 can be a numeral (e.g., the numerals 1 through 4) however it is contemplated that a letter, icon, picture, words, color, or any other visually distinctive feature may serve as indicia to identify adjustable air guides 210. In certain situations, for example, to comply with government regulations, indicia 226 may include features perceptible to persons with sensory impairments, such as Braille labels, acoustic cues, illumination, and so forth.

In some embodiments, VAV diffuser 200 transmits an identifier 415 to user device 120 to enable the user to confirm user device 120 is in communication with the intended VAV diffuser 200. This is useful when, for example, more than one VAV diffuser 200 is present in a single conditioned space 101, or where a communications link with a VAV diffuser in a nearby room may be inadvertently established. In these instances, each available VAV diffuser 200 is listed in a drop down list, a rolling picker, or other suitable user interface element from which the user may select the desired VAV diffuser 200. In some embodiments, user device 120 displays only the VAV diffuser 200 that is physically nearest to user device 120 based on signal strength, signal propagation time, or other suitable criteria. In some embodiments, user device 120 displays VAV diffusers 200 sorted in proximity order, for example, nearest to farthest.

Once the desired adjustable air guide 210 is identified, the user selects, on the user interface, the visual representation of the adjustable air guide 210 to activate a control widget 420, which enables the user to adjust the position of the selected adjustable air guide 210. In the present example, user U2 has activated visual representation 410*b* to select adjustable air guide "B" (210*b*). As seen in FIG. 4B, control widget 420 can be a slider. As control widget 420 is manipulated downward to decrease air volume, an adjustment command is communicated from user device 120 to supervisor module 222, adjustable air guide 210*b* moves upward, reducing the size of air outlet 203*b* and thus decreasing the air flowing towards user U2 to increase user U2's comfort.

Those skilled in the art will recognize that a user that is uncomfortably warm can utilize the disclosed invention in the opposite manner, i.e., to increase the flow of air directed at the user. Similarly, when air handler unit 110 is delivering heated air to conditioned space 101, a user may advantageously employ the disclosed invention to adjust heat delivery as desired.

Reducing the size of air outlet 203*b* to reduce airflow from that air outlet results in a pressure increase within outlet plenum 205 that causes increased airflow from the other air outlets 203*a*, 203*c*, etc. Conversely, when the size of an air outlet is increased, the resultant decreased pressure within outlet plenum 205 causes decreased airflow from the other outlets. Such changes to the airflow directed toward other occupants may affect or impair the comfort of these other occupants. Additionally, outlet noise may increase as a result of increased pressure within outlet plenum 205.

To obviate these undesirable effects, air pressure within outlet plenum 205 is sensed by sensor 214, which communicates a pressure signal to supervisor module 222 of controller 215. In an embodiment, supervisor module 222 records the pressure within outlet plenum 205 prior to an air outlet adjustment. If a pressure change is sensed within outlet plenum 205, for instance, after an adjustment to an adjustable air guide 210, supervisor module 222 causes a corrective adjustment to be made to damper 212 to cancel the pressure change cause by the adjustment of the air guide 210, e.g., to adjust the pressure within outlet plenum 205 to substantially equal to its prior state. Substantially equal may include equal to, or within a predetermined tolerance of, the pre-adjustemnt pressure. For example, substantially equal can include a post-adjustment pressure that is within 5% of the pre-adjustment pressure. In another example, substantially equal can include a post-adjustment pressure that is within 15% of the pre-adjustment pressure. In an embodiment, supervisor module 222 communicates an adjustment signal to damper stepper driver 217, which, in turn, actuates stepper motor 213 to open or close damper 212 as required to effectuate the appropriate pressure adjustment within outlet plenum 205. In an embodiment, supervisor module 222 employs a proportional integral derivative feedback loop (PID) to regulate pressure within outlet plenum 205.

In this manner, the disclosed personalized comfort VAV system 100 enables occupants of a conditioned space to enjoy personalized comfort without affecting the comfort of other occupants of the conditioned space.

FIGS. 5A-5C illustrate an exemplary embodiment of VAV diffuser 200 in various operational states. FIG. 5A depicts VAV diffuser 200 where each adjustable air guide 210*a-d* is in a medium or default position. FIG. 5B depicts VAV diffuser 200 where adjustable air guide 210*b* is in a raised (low flow) position and FIG. 5C depicts VAV diffuser 200 where adjustable air guide 210*b* is in a lowered (high flow) position.

In an embodiment, sensor 214 is configured to sense whether air is flowing though VAV diffuser 200. In an embodiment, supervisor module 222 is configured to ignore an adjustment command received from a user device 110 in the event no airflow is detected. In an embodiment, supervisor module 222 is configured to return adjustable air guides 210 to a preset default position (e.g., a medium position) in the event no airflow has been detected for a predetermined period of time, for example, 30 minutes. In an embodiment, supervisor module 222 is configured to return damper 212 to preset default position (e.g., a full or a medium position) in the event no airflow has been detected for a predetermined period of time (e.g., 30 minutes).

In an embodiment, supervisor module 222 is configured to return adjustable air guides 210 to a preset default position (e.g., a medium position) in the event no occupancy of conditioned space 101 has been detected for a predetermined period of time, for example, 30 minutes. In an embodiment, supervisor module 222 is configured to return damper 212 to preset default position (e.g., a full or a medium position) in the event no occupancy of conditioned space 101 has been detected for a predetermined period of time (e.g., 30 minutes).

In an embodiment, supervisor module 222 may be programmed for provisioning of default positions (of adjustable air guides 210 and/or damper 212) by an installer. In an embodiment, supervisor module 222 may be programmed with a VAV diffuser 200 identifier by an installer.

Figure 6:
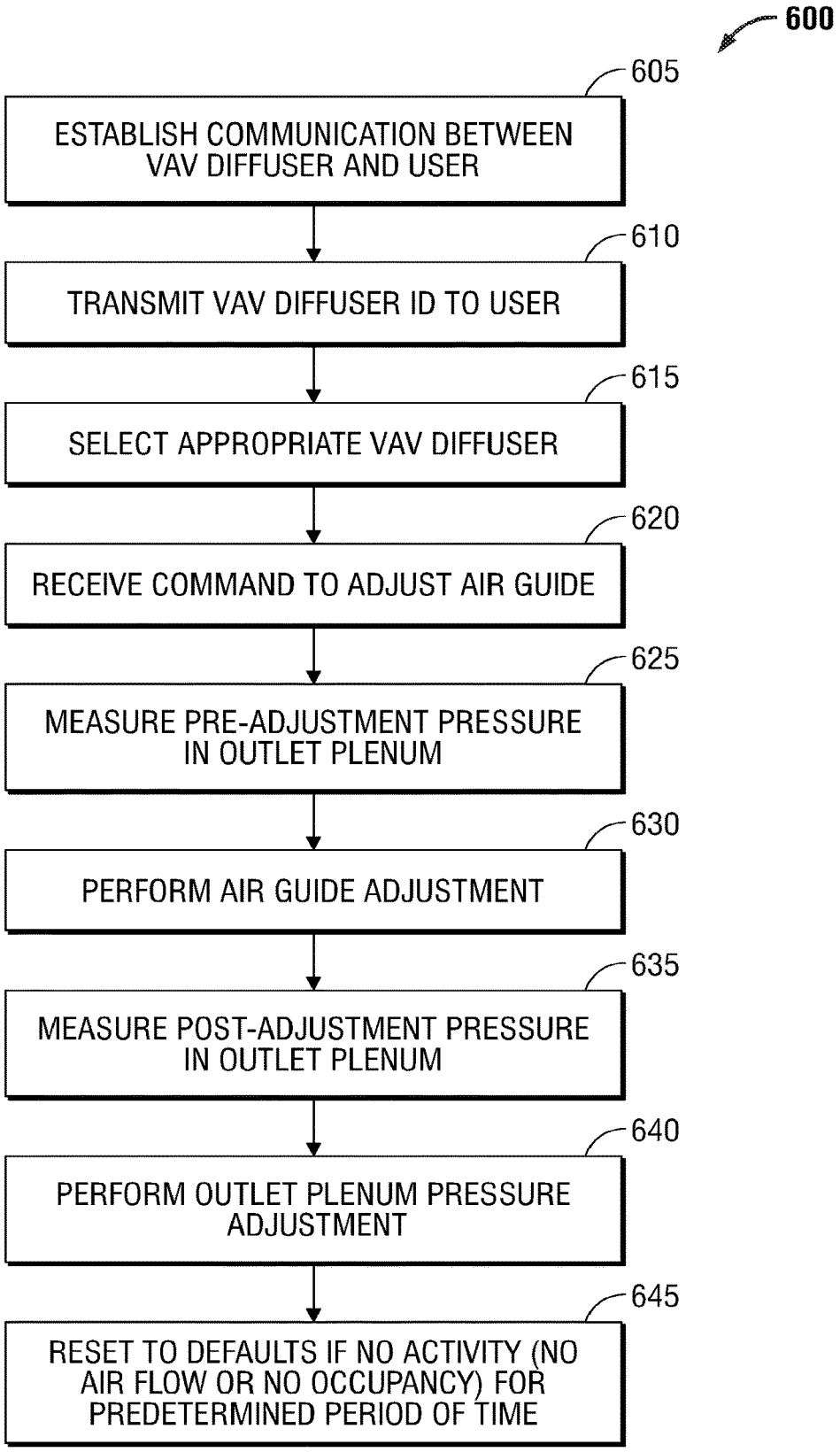
FIG. 6 is a flowchart illustrating a method of operating a personalized comfort VAV diffuser in accordance with an embodiment of the present disclosure.

FIG. 6 is a flowchart of a method 600 of operating a personalized comfort VAV diffuser in accordance with an embodiment of the present disclosure. The method 600 begins with step 605 wherein communication is established between the VAV diffuser and the user. In step 610, a VAV diffuser identifier is communicated to the user, who in step 615 selects a desired VAV diffuser for personalized adjustment. In step 620 the VAV diffuser receives a request to adjust an air guide thereof. In step 625, a pre-adjustment pressure of an outlet plenum of the VAV diffuser is measured, and in step 630, the requested air guide adjustment is performed. In step 635, a post-adjustment pressure of the outlet plenum of the VAV diffuser is measured, whereupon in step 640 the pressure of the outlet plenum is adjusted to substantially equal the pre-adjustment pressure. In step 645, the position of the air guide(s) and the outlet plenum pressure adjustment is reset to default values if no activity is detected for more than a predetermined period of time, such as no air flow through the VAV and/or no occupancy is detected in proximity to the VAV diffuser for a predetermined period of time.

ASPECTS

It is noted that any of aspects 1-20 may be combined with each other in any suitable combination.

Aspect 1. A method of operating a variable air volume diffuser having a plurality of individually adjustable directional outlets, comprising sensing a pre-adjustment pressure within the variable air volume diffuser; adjusting a position of one of the plurality of individually adjustable directional outlets; sensing a post-adjustment pressure within the variable air volume diffuser; and modifying the airflow through the variable air volume diffuser such that the post-adjustment pressure is substantially equal to the pre-adjustment pressure.

Aspect 2. The method in accordance with aspect 1, further comprising sensing the rate of airflow through the variable air volume diffuser.

Aspect 3. The method in accordance with aspect 1 or 2, further comprising determining whether rate of airflow through the variable air volume diffuser is less than a predetermined threshold for a predetermined period of time; and returning the individually adjustable directional outlets to a default position in response to the determining.

Aspect 4. The method in accordance with any of aspects 1-3, further comprising determining whether a rate of airflow through the variable air volume diffuser is less than a predetermined threshold for a predetermined period of time; and returning an airflow-modifying device included in the variable air volume diffuser to a default position in response to the determining.

Aspect 5. The method in accordance with any of aspects 1-4, further comprising receiving an adjustment command from a user device, wherein the adjusting is in response to the adjustment command.

Aspect 6. The method in accordance with any of aspects 1-5, further comprising transmitting a variable air volume diffuser identifier to a user device; and displaying the variable air volume diffuser identifier on the user device.

Aspect 7. The method in accordance with any of aspects 1-6, further comprising selecting, on the user device, selecting a variable air volume diffuser identifier from among a plurality of variable air volume diffuser identifier.

Aspect 8. The method in accordance with any of aspects 1-7, wherein modifying the airflow through the variable air volume diffuser includes changing the position of a damper included within the variable air volume diffuser.

Aspect 9. A variable air volume diffuser, comprising a plurality of individually adjustable directional outlets; and a controller configured to regulate air pressure within the variable air volume diffuser when an individually adjustable directional outlet is adjusted.

Aspect 10. The variable air volume diffuser in accordance with aspect 9, further comprising an actuator in operative communication with the controller and operatively associated with at least one of the individually adjustable directional outlets.

Aspect 11. The variable air volume diffuser in accordance with aspect 9 or 10, wherein the actuator comprises a stepper motor.

Aspect 12. The variable air volume diffuser in accordance with any of aspects 9-11, further comprising a communications interface.

Aspect 13. The variable air volume diffuser in accordance with any of aspects 9-12, wherein the communications interface is configured to receive an adjustment command from a user device.

Aspect 14. The variable air volume diffuser in accordance with any of aspects 9-13, wherein the communications interface is configured to receive an adjustment command spoken by a user.

Aspect 15. The variable air volume diffuser in accordance with any of aspects 9-14, wherein the communications interface is configured to transmit a variable air volume diffuser identifier to a user device.

Aspect 16. The variable air volume diffuser in accordance with any of aspects 9-15, further comprising a damper configured to regulate airflow through the variable air volume diffuser.

Aspect 17. The variable air volume diffuser in accordance with any of aspects 9-16, further comprising an actuator in operative communication with the controller and operatively associated with the damper.

Aspect 18. The variable air volume diffuser in accordance with any of aspects 9-17, further comprising a sensor in operative communication with the controller and configured to sense an air property within the variable air volume diffuser.

Aspect 19. The variable air volume diffuser in accordance with any of aspects 9-18, wherein the sensed air property is selected from the group consisting of an air pressure, a rate of airflow, an air temperature, and an air humidity.

Aspect 20. A personalized comfort variable air volume diffuser system, comprising a variable air volume diffuser having a plurality of individually remotely-adjustable directional outlets; and a user interface presentable on a user device in operative communication with the variable air volume diffuser and configured to remotely adjust an adjustable directional outlet of the variable air volume diffuser. Particular embodiments of the present disclosure have been described herein, however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in any appropriately detailed structure.

What is claimed is:

1. A variable air volume diffuser, comprising:

a damper situated between a space and a supply duct, and configured to control an amount of air flowing from the supply duct to the space;

a plurality of individually adjustable directional outlets comprising:

a first outlet that, when open, allows air to flow into the space in a first direction, and a second outlet that, when open, allows air to flow into the space in a second direction that differs from the first direction; and a controller configured to adjust the damper when one of the plurality of individually adjustable directional outlets is adjusted.

2. The variable air volume diffuser of claim 1, further comprising an actuator in operative communication with the controller and operatively associated with at least one of the plurality of individually adjustable directional outlets.

3. The variable air volume diffuser of claim 1, further comprising a communications interface operable to communicate a signal to the controller that indicates that the one of the plurality of individually adjustable directional outlets should be adjusted.

4. The variable air volume diffuser of claim 3, wherein the communications interface is configured to receive an adjustment command from a user device.

5. The variable air volume diffuser of claim 3, wherein the communications interface is configured to receive an adjustment command spoken by a user.

6. The variable air volume diffuser of claim 3, wherein the communications interface is configured to transmit a variable air volume diffuser identifier to a user device.

7. The variable air volume diffuser of claim 1, further comprising a sensor in operative communication with the controller and configured to sense an air property within the variable air volume diffuser.

8. The variable air volume diffuser of claim 7, wherein the sensed air property is one of an air pressure, a rate of airflow, an air temperature, or an air humidity.

9. The variable air volume diffuser of claim 1, wherein the controller is further configured to regulate air pressure by adjusting the damper when the one of the plurality of individually adjustable directional outlets is adjusted.

10. A personalized comfort variable air volume diffuser system, comprising:

a plenum;

a damper situated between a supply duct and the plenum;

a variable air volume diffuser having a plurality of individually remotely-adjustable directional outlets that are, respectively, configured to direct air, from the plenum, in one or more directions; and a user interface presentable on a device in operative communication with the variable air volume diffuser and configured to remotely adjust one of the plurality of individually remotely-adjustable directional outlets of the variable air volume diffuser and, in response, adjust the damper.

11. The personalized comfort variable air volume diffuser system of claim 10, wherein the variable air volume diffuser is a single diffuser comprising the plurality of individually remotely-adjustable directional outlets and the user interface is configured to present graphical depictions of the single diffuser and the plurality of individually remotely-adjustable directional outlets.

12. The personalized comfort variable air volume diffuser system of claim 10, wherein the device is further configured to receive an adjustment command spoken by a user, wherein the remote adjustment of one of the plurality of individually remotely-adjustable directional outlets of the variable air volume diffuser is in response to the adjustment command.

13. The personalized comfort variable air volume diffuser system of claim 10, wherein the user interface is configured to present a variable air volume diffuser indicator associated with the variable air volume diffuser.

14. The personalized comfort variable air volume diffuser system of claim 10, wherein the variable air volume diffuser further comprises a sensor configured to sense an air temperature within the variable air volume diffuser.

15. The personalized comfort variable air volume diffuser system of claim 14, wherein the user interface is configured to present the sensed air temperature.

16. A method of operating a variable air volume diffuser comprising:

receiving a request to adjust a directional outlet, of the variable air volume diffuser, that is one of a plurality of individually adjustable directional outlets that are configured to discharge air into the common space in one or more directions;

sensing a pressure within a common plenum of the variable air volume diffuser that supplies the plurality of individually adjustable directional outlets;

adjusting the state of the directional outlet based on the request; and changing the position of a damper situated between the common plenum and a supply duct to adjust the pressure within the common plenum.

17. The method of claim 16, further comprising sensing the rate of airflow through the variable air volume diffuser.

18. The method of claim 17, further comprising:

determining whether the rate of airflow through the variable air volume diffuser is less than a predetermined threshold for a predetermined period of time;

and returning the individually adjustable directional outlets to a default position in response to the determining.

19. The method of claim 17, further comprising:

transmitting a variable air volume diffuser identifier to a user device; and displaying the variable air volume diffuser identifier on the user device.

20. The method of claim 16, receiving an adjustment command from a user device, wherein the adjusting is in response to the adjustment command.

* * * * *